United States Patent [19]

Bohrn

[11] B 3,989,448

[45] Nov. 2, 1976

[54] OVERPRINT OF SOLVENT ON TOTAL SOLVENT COATING

[75] Inventor: Walter J. Bohrn, Lancaster, Pa.

[73] Assignee: Armstrong Cork Company, Lancaster, Pa.

[22] Filed: Apr. 12, 1974

[21] Appl. No.: 460,388

[44] Published under the second Trial Voluntary Protest Program on January 27, 1976 as document No. B 460,388.

[52] U.S. Cl. ..... 8/14; 8/115; 8/1 B; 28/74 P; 28/76 P; 156/85

[51] Int. Cl. ..... D44d 1/02

[58] Field of Search ..... 156/72, 84, 85, 277, 156/4, 305, 307; 161/63, 66; 117/11, 63; 28/76 R, 76 T, 76 P, 72 P, 74 P; 26/69 R, 69 A, 69 B, 2 R; 8/130.1, 114, 114.5, 115, 1 XB

[56] References Cited

UNITED STATES PATENTS

| | | | |
|---|---|---|---|
| 705,977 | 7/1902 | Timme | 26/2 R |
| 2,681,867 | 6/1954 | Miller | 8/114.5 |
| 3,402,988 | 9/1968 | Reeves et al. | 8/114 |
| 3,567,548 | 3/1971 | Miller | 117/72 |
| 3,830,683 | 8/1974 | Bohrn | 161/63 |
| 3,849,157 | 11/1974 | Polmer et al. | 156/277 |
| 3,849,158 | 11/1974 | Polmer et al. | 156/277 |
| 3,849,159 | 11/1974 | Polmer et al. | 156/277 |
| 3,856,598 | 12/1974 | Gregorian et al. | 156/85 |

*Primary Examiner*—William A. Powell
*Assistant Examiner*—Michael W. Ball

[57] ABSTRACT

A pile fabric is treated overall with a solution containing a solvent for the fiber comprising the pile fabric. The solvent concentration of the solution is of a sufficiently high level to induce shrinkage of the fiber upon subsequent application of heat. Portions of the fabric before heating are treated with a solution to dilute the solvent on the carpet to a point where it will have minimum or no effect on the fabric. The subsequently heated product then has an embossed effect.

3 Claims, 2 Drawing Figures

Fig. I
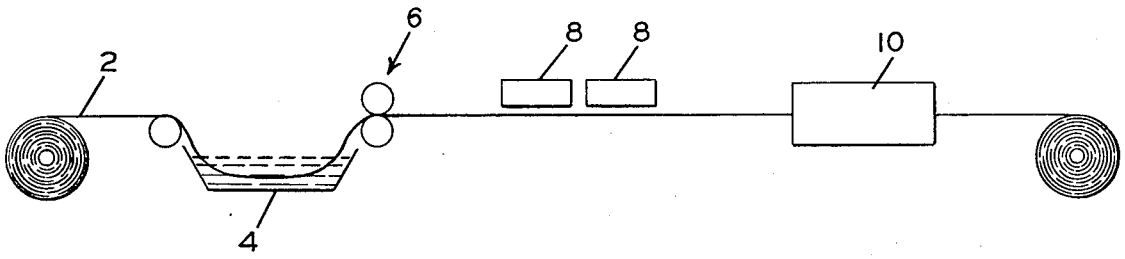
Fig II
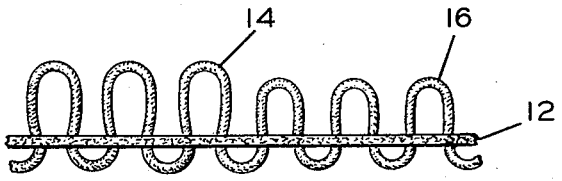

OVERPRINT OF SOLVENT ON TOTAL SOLVENT COATING

BACKGROUND OF THE INVENTION

The invention is directed to a fabric treatment process and, more particularly, to a technique for the solvent embossing of carpet.

DESCRIPTION OF THE PRIOR ART

Pile carpets presenting an embossed appearance were originally made by weaving a pile carpet fabric with tufts of uniform height and thereafter cutting certain of the tufts or pile yarns by hand to the desired design or pattern, or, alternately, they were woven with pile yarns of different heights by means of specially equipped looms, such as Wilton looms, with special jacquard or pile wire mechanisms. These methods and the equipment required were slow, costly and required specialized skills.

Various attempts have been made to create an embossed pattern effect on tufted pile carpet material by less expensive equipment and processes. Thus, as shown in U.S. Pat. No. 2,723,937, it has been proposed to apply adhesive to the pile of a carpet material and then subject the pile of the carpet to compacting by heated rollers in a desired design pattern. It has also been proposed in U.S. Pat. No. 3,567,548 to impart an embossed design appearance to carpet and other pile fabric material by printing the surface of the carpet in the desired pattern with a solvent material which may contain adhesive. Thereafter, the fabric is subjected to dry heat and to compacting and finally to re-lofting of the pile elements.

These prior art attempts to obtain an embossed pattern effect in tufted carpet material by means of a solvent and/or adhesive have proven to be generally unsatisfactory and had many shortcomings. Thus, where adhesive is employed in connection with compacting of the pile yarns to attain a sculptured or embossed effect, various chemicals such as dry-cleaning fluids along with abrasion serve to release a certain proportion of the compacted pile yarns, thus destroying the desired embossed design appearance or destroying or spoiling the uniformly sculptured appearance thereof. When an attempt was made to obtain the desired sculptured or embossed design appearance by means of solvents, it is difficult to obtain a uniformly embossed appearance or an aesthetically acceptable appearance, particularly at the desired depth of embossing to present the proper sculptured appearance.

It has also been proposed to treat the entire face surface of a tufted carpet material with a dilute solution of a solvent so as to impart the desired bonded finish to the face surface as shown in U.S. Pat. No. 3,053,609. However, no pattern embossed effect is obtained by means of this procedure.

Materials other than carpet materials have been also treated with various solvents and adhesives to obtain various effects, but these various processes and treatments do not present the same problems as are encountered in creating an embossed pattern effect on tufted carpet material. Thus, in U.S. Pat. No. 2,110,866, relatively light weight upholstery or decorative pile fabric having tufted face surface yarns made of animal fibers, such as wool or mohair, are treated with a relatively dilute solution or paste to shrink the animal fibers.

However, the process disclosed in the above patent cannot practically be employed to create a satisfactory embossed pattern effect on all tufted carpet material, particularly on all tufted carpet material in which the face yarns are made of synthetic materials.

In U.S. Pat. Nos. 705,977 and 1,980,191, a decorative pile fabric such as an upholstery fabric is treated with a solvent material so as to completely destroy the fibers in the treated areas, and the destroyed fibers are then removed by brushing. The processes disclosed in these patents would not be applicable to tufted carpet material to produce the desired sculptured design effect and the complete destruction of the pile yarns in the treated areas would, for most purposes, destroy the desired embossed appearance and the utility of the product.

In addition to the foregoing, plain non-pile fabrics have also been treated in selected areas with various solvents to impart a wrinkled or seersucker appearance to the fabric as shown in U.S. Pat. No. 3,505,000 and British Pat. No. 544,820, accepted Apr. 29, 1942. The treatment disclosed in these patents is quite unsuited for a tufted carpet material since a crinkled or seersucker effect would prevent the carpet from lying smoothly or evenly on the floor and since it would not give the desired sculptured or embossed effect to the tufted pile face.

SUMMARY OF THE INVENTION

The invention involves the treatment of a pile fabric to secure an embossed effect thereon. A heavy pile fabric, for example carpeting, is treated overall with a solution containing a solvent for the fiber comprising the pile fabric. The concentration of the solvent is at a sufficiently high level so as to introduce shrinkage of the fiber yarns of the pile fabric upon subsequent application of heat or steam. The solvent wetted fabric is printed with one or more decorative, non-solvent or extremely low solvent inks and then subjected to heat in the form of saturated steam. In the unprinted areas of the fabric, the fabric receives the full effect of the solvent and consequently the yarns shrink to approximately 50 percent of the original pile height. In the printed areas, the solvent solution concentration is reduced or diluted as the result of the overprint of the decorative inks. As a result thereof the printed areas have controlled shrinkage or no shrinkage. This results in a very pleasing sculptured visual with the printed elements raised above the background non-overprinted area. Dye can be added to the solvent solution to simultaneously dye the background if desired.

BRIEF DESCRIPTION OF THE DRAWING

FIG. I is a schematic view of the process of making the product herein; and

FIG. II is a cross-sectional view of a product made according to the process herein.

DESCRIPTION OF THE PREFERRED EMBODIMENTS

Referring now to the FIG. I embodiment in the drawing, a pile fabric, for example carpeting 2, is provided with an overall coating of a solution containing a solvent for the fiber comprising the pile fabric. As shown in FIG. I the carpet 2 is dipped in a tank 4 having the solvent solution. The solution may or may not contain dyes. Dyes would serve for background coloration. The carpet is then passed through squeeze rollers 6 which remove the excess solution from the carpet 2. The concentration of the solvent in the solution is at a sufficiently high level so as to induce shrinkage of the fiber yarns of the pile fabric upon a subsequent application of heat or steam. Should the pile fabric move from the squeeze rollers into a heating chamber, the solvent would act upon the carpet uniformly and there would be about a 50 percent shrinkage in the pile height of the fabric.

However, the overall solvent treated carpet 2 is not heated, but is passed to a series of printing stations 8. Here the fabric will be printed with a design using any required number of printing stations. The printing ink may contain dyes or may be colorless. The important thing at this point is that the printing ink contain no solvent or only a very dilute solution of solvent. Consequently, in those areas where there is printing, the printing solution will tend to dilute in the printed areas only the overall solvent containing solution and lower the solvent concentration in the total solution on the carpet in the printed areas (original solvent solution plus printed solution), so that there will be controlled or no fiber shrinkage in the printed areas. This will occur simply because the solution has now had the solvent diluted to the point where it has little or no effect upon the fibers upon subsequent heating. The carpet then passes into a heating chamber 10 which could be any conventional heating means, preferably though it should be saturated steam. The heating will set the dyes if they are used and at the same time cause the solvent, if at a high enough concentration, to shrink the pile loops of the pile fabric. Conventional washing and drying can then be carried out.

There is then formed the product which is shown in FIG. II. A conventional backing 12 has the loops tufted therethrough and the loops 14 occur in those areas where there has been the printing by the non-solvent containing inks while the loops 16 result in those areas that had only the solvent containing solution treatment. Loops 16 have been treated only with the overall solution containing a solvent strong enough to cause shrinkage. The loops 14 contain initially the same solvent solution, but the printing solution diluted the solvent concentration to the point that the solvent had little or no effect upon the loops 14 and, therefore, the loops retained substantially their full size such as they had prior to the steaming treatment. This provides a very pleasant sculptured visual with the printed elements being raised above the carpet background. That is, loops 14 form the printed area and this is raised above the background which is formed with loops 16. The process could be equally well employed with either loop or cut pile fabric.

In one practical form of the invention, the tufted pile acrylic carpet material, having a non-woven polypropylene backing with a tufted face surface yarn having a denier of about 5200 needled thereinto to a weight of 35 oz. per square yard of carpet material, is passed into a dip tank 4 containing an aqueous solution of ethylene carbonate with the ethylene carbonate comprising approximately 40 percent by weight of the solution. Acceptable visual effects can be secured by using a concentration of ethylene carbonate ranging from about 35 percent to 47.5 percent by weight of the aqueous solution.

The carpet then passes to the printing station 8 wherein there is printed a carpet design thereon using an aqueous solution of Basic Blue 69 dye. It is obvious that the carpet will be fairly well saturated with solution when it is passed through the dip tank. However, the squeeze rolls 6 remove excess material from the carpet so that there exists on the carpet about 3.42 oz. of solvent solution per square foot of carpet. The printer then places the pattern on the carpet surface and applies inks in a solution at the rate of 5.1 oz. of ink solution per square foot. The solvent now exists not in the solution which came from the dip bath 4 alone, but now sits in a solution which is the composite of the solution from the dip tank and the ink solution from the printer. This lowers the concentration of the ethylene carbonate down to no more than approximately 25 percent by weight of the total solution. It has been found that if the ethylene carbonate is in a solution at a concentration of less than about 25 percent by weight of the solution, the ethylene carbonate will then have very little effect upon the carpet tufts as far as shrinkage of the tufts is concerned. The carpet then passes through a steam chamber in which saturated steam at a temperature of approximately 212° to 220°F. is applied to the carpet for about 5 minutes. This then provides the carpet product shown in FIG. II.

In another example of the invention herein, a tufted pile nylon carpet material having a woven polypropylene backing with a tufted face surface yarn having a denier of about 3825 needled thereinto to a weight of 28 oz. per square yard of carpet material is passed into a dip tank 4 containing an aqueous solution of zinc chloride with the zinc chloride comprising approximately 56 percent by weight of the solution and applied at the rate of 2.29 oz. of solvent solution per square foot of carpet. This concentration of solvent will provide a definite embossed effect. At a concentration above about 55 percent and up to 62.5 percent of solvent acceptable embossing occurs. It has been found that the amount of overprint material added must reduce the solvent concentration in the total solution to less than 35 percent to prevent embossing. Overprint material at an application rate of 5.1 oz. per square foot will reduce the solvent concentration in the total solution to less than 35 percent (herein about 16 percent).

In another example of the invention herein, a tufted pile polyester carpet material having a non-woven polypropylene backing with a tufted face surface yarn having a denier of about 13500 needled thereinto to a weight of 45 oz. per square yard of carpet material is passed into a dip tank 4 containing an aqueous solution of phenol with the phenol comprising approximately 80 percent by weight of the solution. The phenol solution is applied at the rate of 10.1 oz. per square foot. This concentration of solvent will provide a definite embossed effect. At a concentration between about 70–90 percent of solvent some embossing occurs. It has been found that the amount of overprint material added must reduce the solvent concentration in the total solution to less than 60 percent. Overprint ink material applied at the rate of 5.1 oz. per square foot will reduce the solvent concentration herein to about 54 percent.

The above three examples refer to three commonly used pile fabric materials. It is obvious that other materials could be used, such as, wool, rayon, etc. The best practical solvents have been indicated for the above fibers. However, it is obvious that other solvents could be used. For example, certain nylon fibers can be treated with resorcinol while other nylon fibers can be treated with zinc chloride. Likewise, solvent concentrations can be varied so that both the printed and non-printed areas could have some yarn shrinkage. Conversely, only very dilute solvents could be used in only the non-printed areas, and thus very little embossing is provided. Finally, it is obvious that as the weight of the carpet structure is changed, so too the various concentrations must be varied. A thicker carpet will require more solvent and, consequently, more dilution where needed. The essence of the invention resides in the fact that there is an overall coating of a pile fabric with a material that has a solvent that can affect the pile fabric. Then certain portions of the total surface area which have been totally treated with a solvent are printed with a second solution coating which results in a dilution of the solvent concentration in the printed areas. This results in the finished product having a difference in the shrinkage between those areas which are printed versus those areas which are not printed. This difference herein always means that those areas which are not printed have a greater shrinkage than those areas which are printed.

What is claimed is:

1. The method of forming an embossed pattern effect on pile fabric material which consists of the steps of:

a. first providing a carpet material with a backing and a pile upper face surface, the pile face surface containing fibers which may be shrunk by a selected solvent while the backing material will be unaffected by the solvent solution, b. applying a first solvent solution to the total fiber face surface of the carpet to saturate the full length of the fibers with solvent solution, said solvent solution applied being of a concentration that can cause shrinkage of the pile face surface fibers, c. subsequently applying to only selected areas of the fiber face in a desired pattern a second solution which will dilute the total originally applied solvent-containing solution in the pattern areas to the point that the solvent now in the total solution will have little or no effect upon the fibers of the pile surface to shrink the fibers, and d. thereafter subjecting the pile fabric to heat to cause the yarns in the fiber face surface which have been only wetted by the first solvent-containing solution to shrink and present a desired embossed pattern appearance since in those areas where there has been the printing of the second solution, the solvent concentration has been diluted to the point that the solvent has very little or no shrinkage effect upon the fibers of the pile surface and, therefore, a two-level pile surface results.

2. The method of creating an embossed pattern effect on a fibrous material as set forth in claim 1 wherein the printed second solution contains dyes to color the pile fabric in the printed areas.

3. The method of creating an embossed pattern effect on a fibrous material as set forth in claim 2 wherein the first solvent solution contains a dye.

* * * * *